US006007006A

United States Patent [19]

Engel et al.

[11] Patent Number: 6,007,006

[45] Date of Patent: Dec. 28, 1999

[54] FOOD WASTE DISPOSER

[75] Inventors: Lisa M. Engel, Elkhorn; David W. Barke; William F. Strutz, both of Racine; William R. McCormick, Kenosha, all of Wis.

[73] Assignee: Emerson Electric Co., St. Louis, Mo.

[21] Appl. No.: 09/121,473

[22] Filed: Jul. 23, 1998

[51] Int. Cl.[6] ..... B02C 23/36

[52] U.S. Cl. ..... 241/46.014; 29/428

[58] Field of Search ..... 264/328.1; 29/428; 4/DIG. 4; 241/46.013, 46.014, 46.015, 46.016

[56] References Cited

U.S. PATENT DOCUMENTS

| | | | |
|---|---|---|---|
| 2,495,983 | 1/1950 | Richards . | |
| 2,579,400 | 12/1951 | Schindler . | |
| 2,679,981 | 6/1954 | Eisinga . | |
| 2,743,875 | 5/1956 | Brezosky et al. | 241/46.014 |
| 2,782,997 | 2/1957 | Wolff . | |
| 2,829,838 | 4/1958 | Macemon . | |
| 2,951,650 | 9/1960 | Gould | 241/46.014 |
| 2,978,190 | 4/1961 | Brucken et al. | 241/46.014 |
| 3,071,328 | 1/1963 | Higer . | |
| 3,443,764 | 5/1969 | Wetzel . | |
| 3,445,518 | 5/1969 | Chambers, Sr. . | |
| 3,534,913 | 10/1970 | Lawrenson . | |

*Primary Examiner*—Mark Rosenbaum
*Attorney, Agent, or Firm*—Arnold White & Durkee

[57] ABSTRACT

A food waste disposer comprises an upper food conveying section, a lower motor section, and a central grinding section disposed between the food conveying section and the motor section. The motor section includes a motor imparting rotational movement to a motor shaft. The food conveying section includes a first injection-molded plastic housing that forms an inlet at its upper end for receiving food waste. The food conveying section conveys the food waste to the central grinding section. The grinding section includes a grinding mechanism having a portion mounted to the motor shaft. The grinding mechanism grinds the food waste into particulate matter. The central grinding section includes a second injection-molded plastic housing encompassing the grinding mechanism and integrally formed with the first injection-molded plastic housing. The motor is enclosed within a motor housing having a stamped metal upper end frame. The upper end frame separates the grinding mechanism from the motor and is separately formed from the first and second plastic housings.

38 Claims, 6 Drawing Sheets

FOOD WASTE DISPOSER

FIELD OF THE INVENTION

The present invention relates generally to food waste disposers and, more particularly, to a food waste disposer that is less expensive to manufacture than existing disposers.

BACKGROUND OF THE INVENTION

FIG. 1 depicts a vertical cross-section of a typical food waste disposer. The disposer may be mounted in a well-known manner in the drain opening of a sink using mounting members of the type disclosed in U.S. Pat. No. 3,025,007, which is owned by the assignee of the present application.

The disposer includes an upper food conveying section 12, a lower motor section 14, and a central grinding section 16 disposed between the food conveying section and the motor section. The food conveying section 12 includes an injection-molded plastic housing 18 that forms an inlet 20 at its upper end for receiving food waste. The food conveying section 12 conveys the food waste to the central grinding section 16. The motor section 14 includes an induction motor 22 imparting rotational movement to a motor shaft 24. The motor 22 is enclosed within a motor housing 26 having a die-cast metal upper end frame 28, a stamped metal lower end frame 30, and a stator band 32 extending between the upper and lower end frames 28 and 30.

The grinding section 16 includes a grinding mechanism having a circular plate 34, a pair of lugs 36, and a stationary shredder ring 38. The plate 34 is mounted to the motor shaft 24 of the motor section 14. The lugs 36 are fastened to the plate 34 but are free to rotate relative to the rotating plate 34. The grinding section 16 includes a die-cast metal housing 40 integrally formed with the die-cast upper end frame 28 of the motor housing 26. The combination of the housing 40 and upper end frame 28 may be referred to as an upper end bell. The housings 18, 40, and 26 of the respective food conveying section 12, grinding section 16, and motor section 14 are fastened together by a plurality of bolts 41. To prevent the food waste from leaking between the housings 18 and 40, a rubber O-ring 43 is inserted therebetween.

The housing 40 of the grinding section 16 encompasses the grinding mechanism. The shredder ring 38, which includes a plurality of spaced teeth 42, is fixedly attached to an inner surface of the housing 40. In the operation of the food waste disposer, the food waste delivered by the food conveying section 12 to the grinding section 16 is forced by the lugs 36 against the teeth 42 of the shredder ring 38. The sharp edges of the teeth 42 grind the food waste into particulate matter sufficiently small to pass from above the grinding plate 34 to below the grinding plate 34 via gaps between the teeth 42 outside the periphery of the plate 34. Due to gravity, the particulate matter that passes through the gaps between the teeth 42 drops onto the upper end frame 28 and, along with water injected into the disposer, is discharged through a discharge outlet 44 into a tailpipe 46. As best shown in FIG. 2, the tailpipe 46 is connected to the discharge outlet 44 by a non-conventional fitting consisting of a gasket 48, a flange 50, and a pair of screws 52.

Although the food waste disposer in FIG. 1 operates efficiently and effectively, manufacturers are continually striving to facilitate the manufacture and assembly of such disposers and reduce manufacturing costs without sacrificing the efficiency and effectiveness of the disposer's operation.

SUMMARY OF THE INVENTION

To that end, the present invention provides a food waste disposer comprising an upper food conveying section, a lower motor section, and a central grinding section disposed between the food conveying section and the motor section. The motor section includes a motor imparting rotational movement to a motor shaft. The food conveying section includes a first injection-molded plastic housing that forms an inlet at its upper end for receiving food waste. The food conveying section conveys the food waste to the central grinding section. The grinding section includes a grinding mechanism having a portion mounted to the motor shaft. The grinding mechanism grinds the food waste into particulate matter.

The central grinding section includes a second injection-molded plastic housing encompassing the grinding mechanism and integrally formed with the first injection-molded plastic housing. The motor is enclosed within a motor housing having a stamped metal upper end frame. The upper end frame separates the grinding mechanism from the motor and is separately formed from the first and second plastic housings. By integrating the first and second plastic housings via injection molding and separately forming the upper end frame from stamped metal, the food waste disposer is easier and less expensive to manufacture than existing disposers such as that shown in FIG. 1.

The second plastic housing forms a discharge outlet having a threaded outer surface. Since the discharge outlet has a threaded outer surface, a tailpipe can be connected to the discharge outlet using a standard plumbing nut. By designing the discharge outlet to accept a standard plumbing nut, the food waste disposer is significantly easier to connect to a plumbing system in the field than existing disposers such as that shown in FIG. 1.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which.

Figure 1:
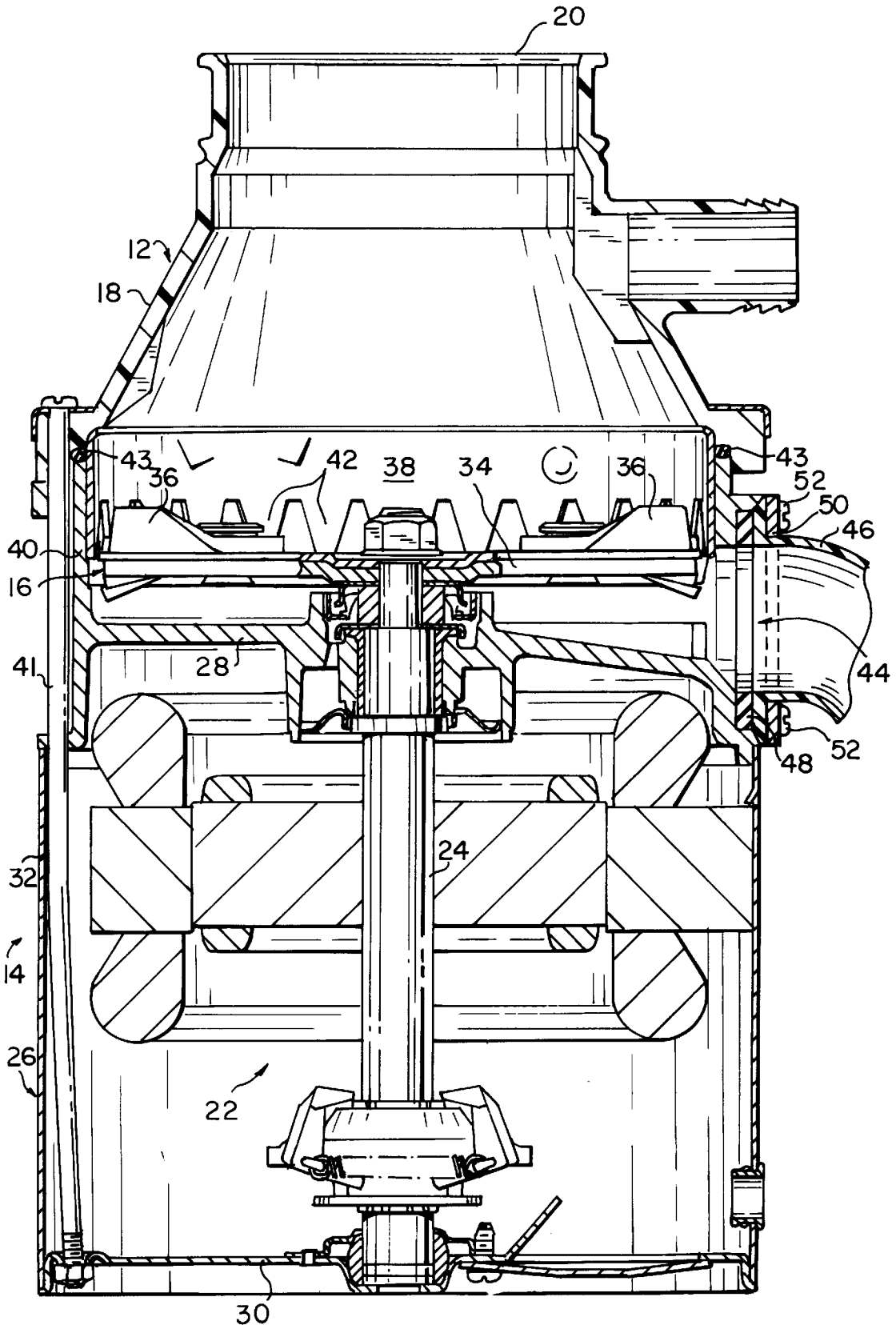
FIG. 1 (PRIOR ART)
FIG. 1 is a cross-section of a typical prior art food waste disposer.
Figure 2:
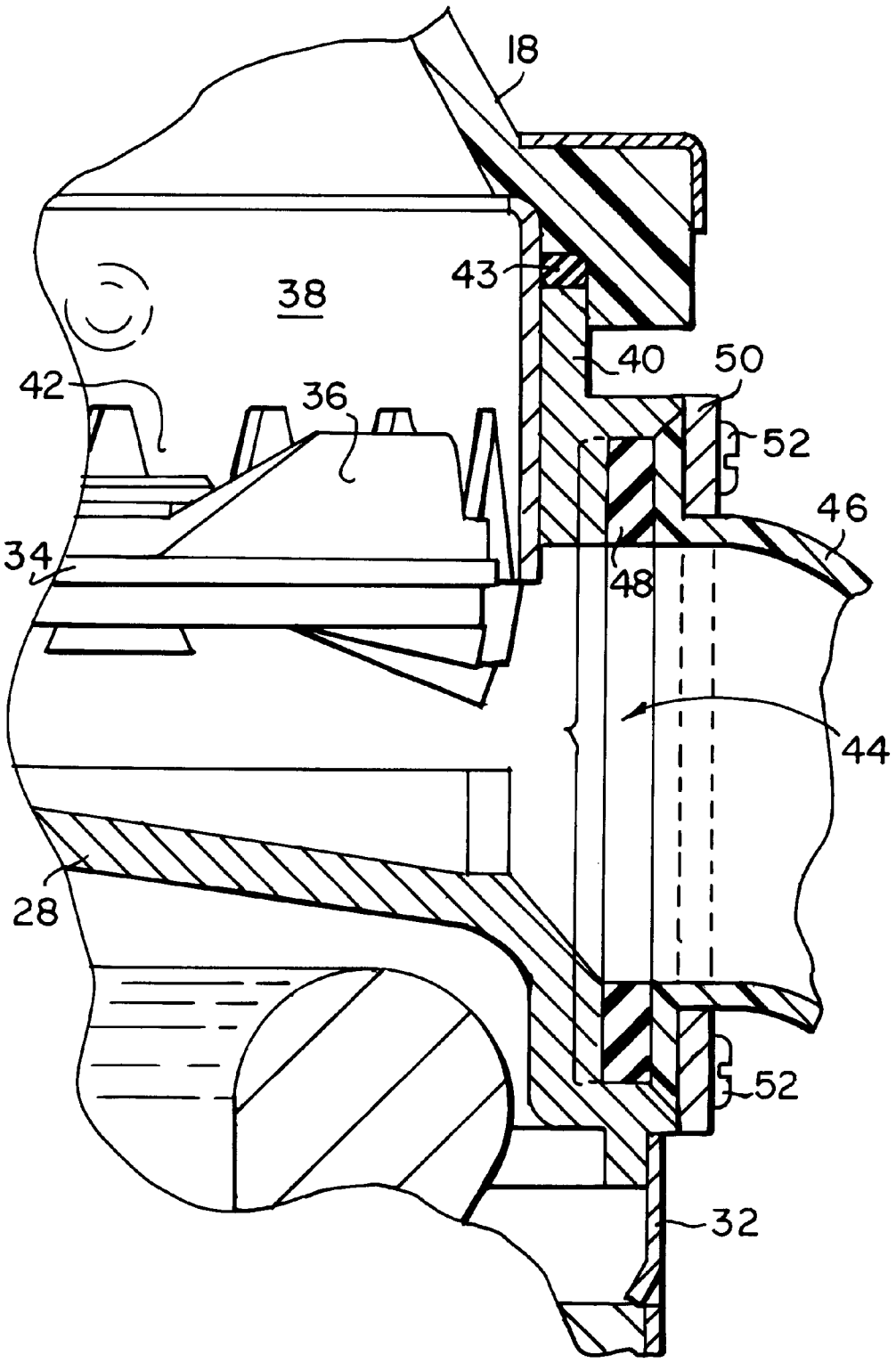
FIG. 2 (PRIOR ART)
FIG. 2 is an enlarged cross-section of a portion of the disposer in FIG. 1 showing a discharge outlet.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF ILLUSTRATIVE EMBODIMENTS

Figure 3:
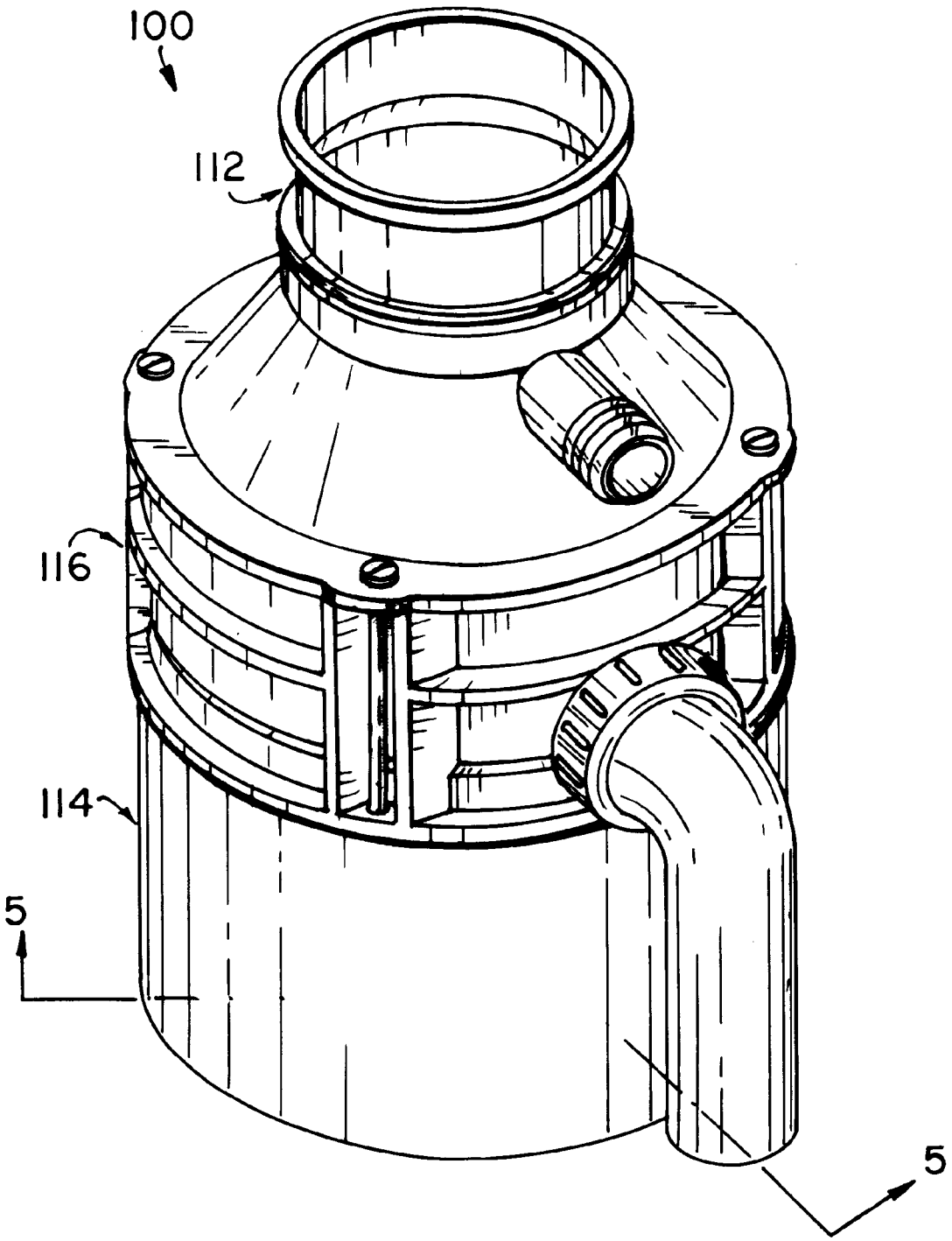
FIG. 3 is a perspective view of a food waste disposer embodying the present invention.

Turning to the drawings, FIG. 3 depicts a food waste disposer 100 embodying the present invention. The disposer 100 may be mounted in a well-known manner in the drain opening of a sink using conventional mounting members of the type disclosed in U.S. Pat. No. 3,025,007, which is owned by the assignee of the present application and incorporated herein by reference in its entirety. The disposer includes an upper food conveying section 112, a lower motor section 114, and a central grinding section 116 disposed between the food conveying section 112 and the motor section 114.

Figure 4:
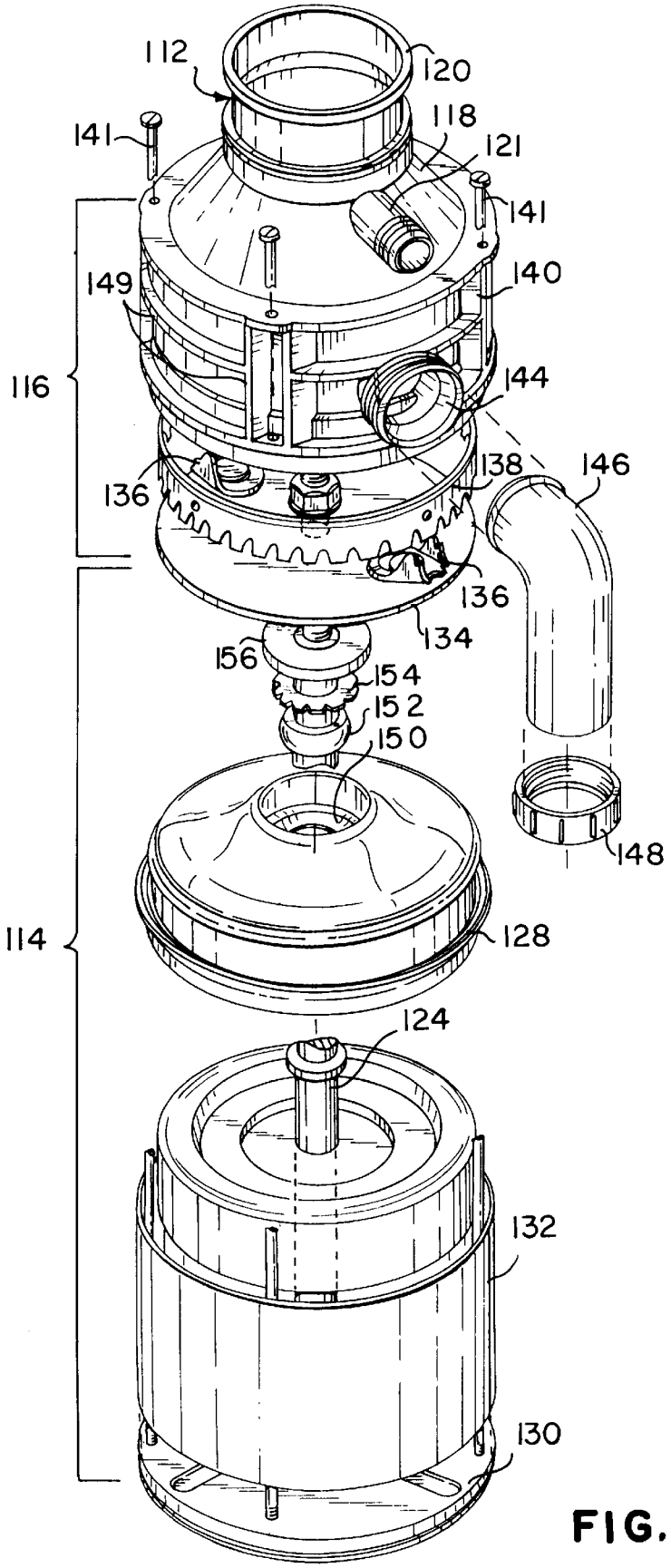
FIG. 4 is an exploded perspective view of the disposer.
Figure 5:
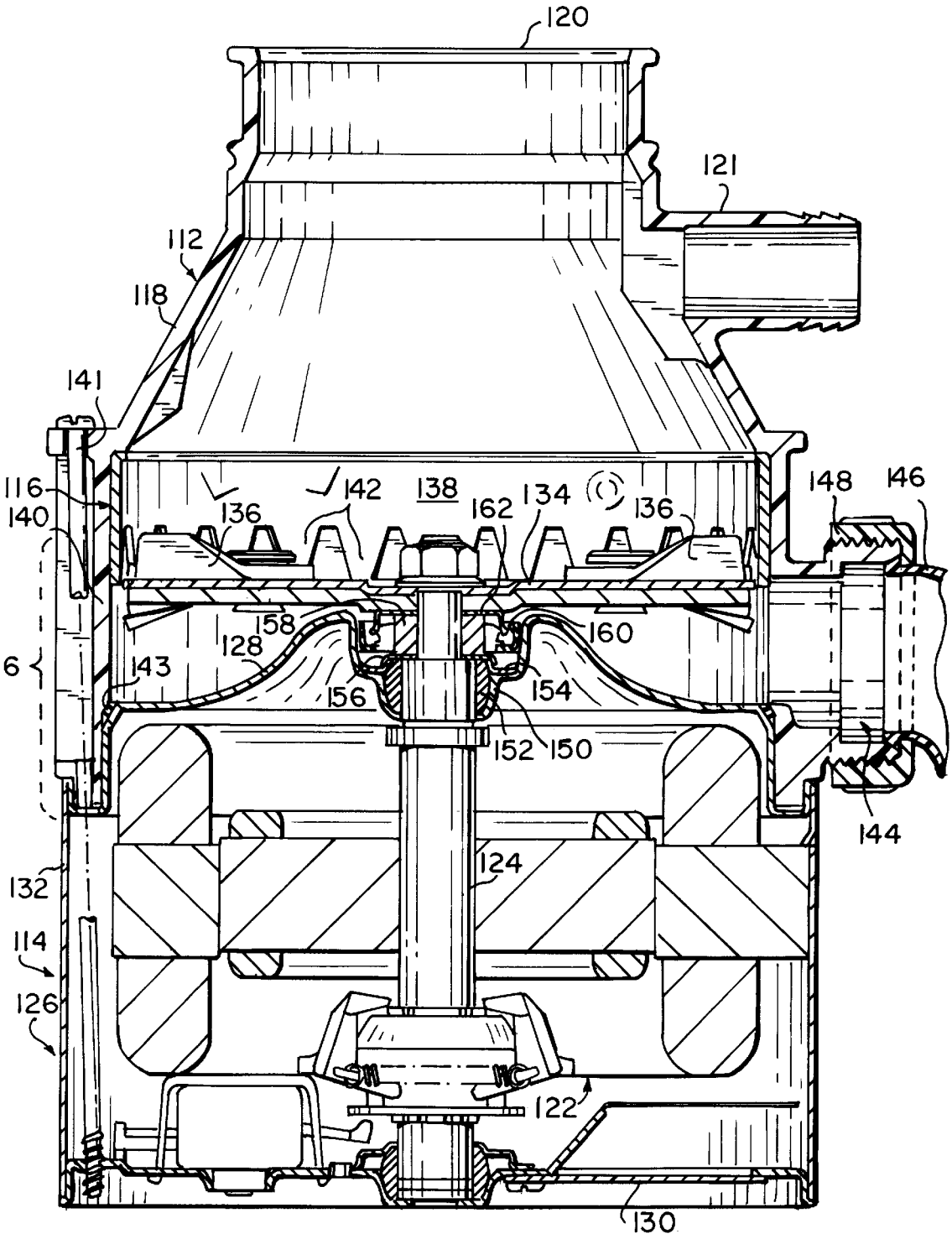
FIG. 5 is a cross-section taken generally along line 5—5 in FIG. 3.

Referring to FIGS. 4 and 5, the food conveying section 112 includes an injection-molded plastic housing 118 that forms an inlet 120 at its upper end for receiving food waste and water. The housing 118 also forms an inlet 121 for passing water discharged from a dishwasher (not shown). The food conveying section 112 conveys the food waste to the central grinding section 116. The motor section 114 includes an induction motor 122 imparting rotational movement to a motor shaft 124. The motor 122 is enclosed within a motor housing 126 having a stamped metal upper end frame 128, a stamped metal lower end frame 130, and a bent metal stator band 132 extending between the upper and lower end frames 128 and 130.

The grinding section 116 includes a grinding mechanism having a circular plate or disc 134, a pair of lugs 136, and a stationary shredder ring 138. The plate 134 is mounted to the motor shaft 124 of the motor section 114. The lugs 136 are fastened to the plate 134 but are free to rotate relative to the rotating plate 134. The grinding section 116 includes an injection-molded plastic housing 140 integrally formed with the injection-molded upper housing 118 of the food conveying section 112. The integrated injection-molded plastic housings 118 and 140 form a unitary plastic enclosure. The enclosure 118, 140 is fastened to the lower end frame 130 by a plurality of bolts 141 having self-tapping threads.

Figure 7:
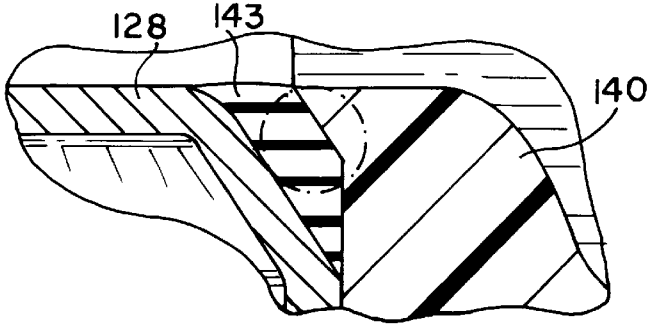
FIG. 7 is a magnified cross-section taken generally of area 7 in FIG. 6.

To prevent the food waste from leaking between the housing 140 and the upper end frame 128, a sealant bead 143 is applied therebetween as best shown in FIG. 7. The sealant bead 143 is preferably composed of a tacky, malleable material that fills any voids between the housing 140 and the upper end frame 128 and tempers any irregularities in the opposing surfaces of the housing 140 and the upper end frame 128. Some suitable malleable materials for the sealant bead 143 include butyl sealant, silicone sealant, and epoxy.

Referring again to FIGS. 4 and 5, the housing 140 of the grinding section 116 encompasses the grinding mechanism. The shredder ring 138, which includes a plurality of spaced teeth 142, is fixedly attached to an inner surface of the housing 140 by an interference fit and is preferably composed of galvanized steel. Since the housing 140 is composed of injection-molded plastic instead of die-cast metal, the housing 140 is resistant to corrosion from the shredder ring 138. In the operation of the food waste disposer, the food waste delivered by the food conveying section 112 to the grinding section 116 is forced by the lugs 136 on the rotating plate 134 against the teeth 142 of the shredder ring 138. The sharp edges of the teeth 142 grind or comminute the food waste into particulate matter sufficiently small to pass from above the grinding plate 134 to below the grinding plate 134 via gaps between the teeth 142 outside the periphery of the plate 134. Due to gravity, the particulate matter that passes through the gaps between the teeth 142 drops onto the upper end frame 128 and, along with water injected into the disposer 100 via the inlet 120, is discharged through a discharge outlet 144 into a tailpipe 146. To direct the mixture of particulate matter and water toward the discharge outlet 144, the upper end frame 128 is sloped downward toward its periphery.

As shown in FIGS. 4 and 5, the discharge outlet 144 is formed by the plastic housing 140 and has a threaded outer surface. The threaded outer surface of the discharge outlet 144 allows the tailpipe 146 to be connected to the discharge outlet 144 using an off-the-shelf plumbing nut 148. By designing the discharge outlet 144 to accept the standard plumbing nut 148, the food waste disposer 100 is significantly easier to connect to a plumbing system in the field than existing disposers. Unlike the prior art disposer in FIG. 1, there is no need for a non-conventional fitting consisting of numerous components.

Figure 6:
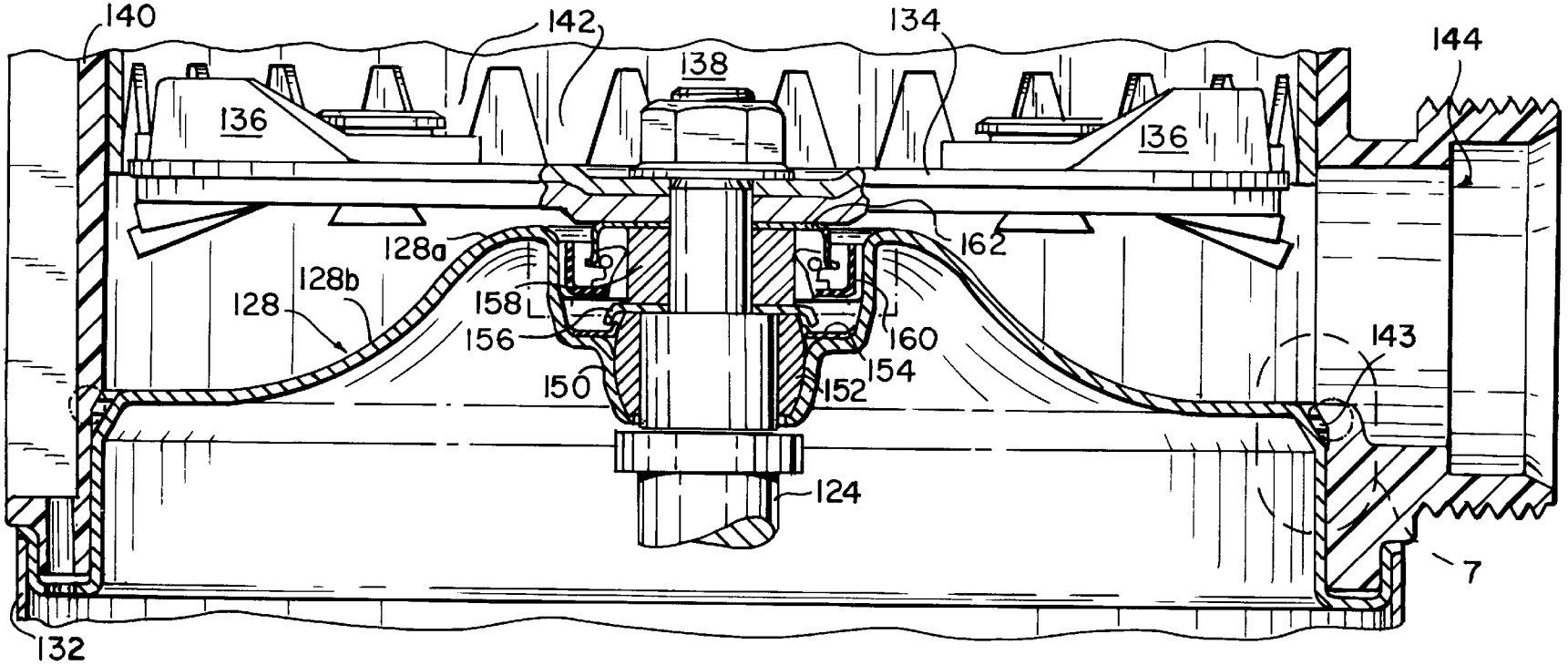
FIG. 6 is an enlarged cross-section of a portion of the disposer showing an upper end frame of a motor housing.

Referring to FIGS. 5 and 6, the stamped metal upper end frame 128 separates the grinding section 116 from the motor 122. To promote concentricity of the motor shaft 124 relative to the stator band 132 and of the grinding plate 134 relative to the shredder ring 138, a peripheral lip of the upper end frame 128 is secured between the plastic housing 140 and the stator band 132. The upper end frame 128 dissipates the heat generated by the motor 122, prevents particulate matter and water from contacting the motor 122, and directs the mixture of particulate matter and water to the discharge outlet 144.

To align the motor shaft 124 relative to the stator band 132 and, at the same time, permit rotation of the motor shaft 124 relative to the upper end frame 128, the upper end frame 128 forms a central bearing pocket 150 supporting a powdered metal spherical bearing 152. The spherical bearing 152 encompasses the motor shaft 124 and is retained in the bearing pocket 150 by a steel bearing retainer 154. To evenly distribute downward loads created by the grinding mechanism onto the bearing 152, a thrust washer 156 encompasses the motor shaft 124 and is positioned immediately above the spherical bearing 152. A steel sleeve 158 encompasses the motor shaft 124, is positioned immediately above the thrust washer 156, and is surrounded by a spring-loaded rubber seal 160. Finally, the steel sleeve 158 is covered by a steel cap 162 for keeping out debris.

The combination of the spherical bearing 152 and bearing retainer 154 is advantageous because it allows for increased manufacturing tolerances in the upper end frame 128. Specifically, it allows for self-alignment of the motor shaft 124 relative to the stator band 132 even in the presence of dimensional instabilities in the upper end frame 128 during its manufacture. This, in turn, facilitates the manufacture of the disposer 100. In contrast, the prior art disposer in FIG. 1 includes a cylindrical flange bearing in the bearing pocket of the upper end frame. Such a flange bearing prevents self-alignment of the motor shaft, thereby requiring greater dimensional stabilities in the upper end frame during its manufacture to achieve proper alignment of the motor shaft from one disposer to the next.

An advantageous feature of the disposer 100 is that the plastic housings 118 and 140 are integrally formed with each other using conventional injection-molding techniques, and that the metal upper end frame 128 is separately formed from the housings 118 and 140 using conventional cold stamping techniques. By integrating the plastic housings 118 and 140 via injection molding and separately forming the upper end frame 128 from stamped metal, the food waste disposer 100 is easier and less expensive to manufacture than existing disposers. Unlike the prior art disposer in FIG. 1, the disposer housings 118, 140, and 126 do not include any expensive die-cast components.

The injection-molded plastic housings 118 and 140 are composed of a plastic material that exhibits impact resistance, heat resistance, and corrosion resistance. Some suitable plastic materials for the housings include acrylonitrile butadiene styrene (ABS), polyvinyl chloride (PVC), polyester, and polyphenylene sulfide. The housings 118 and 140 preferably have a wall thickness ranging from about 0.120 inch to about 0.160 inch. In a preferred embodiment, the housings 118 and 140 are composed of wall nd have a wall thickness of about 0.140 inch. To enhance the structural rigidity of the housing 140, the housing 140 is preferably provided with a plurality of stiffening ribs 149 (FIG. 4).

The upper end frame 128 is preferably composed of stamped metal that is capable of conducting the heat generated by the motor 122 to the water flowing through the disposer and is sufficiently rigid to withstand downward loading forces applied by the rotatable plate 134 of the grinding mechanism. Some suitable metals include double-sided galvanized cold-rolled steel, cold-rolled steel, stainless steel, and other types of steel. Alternatively, the upper end frame 128 may be composed of a structurally rigid plastic material capable of dissipating the heat generated by the motor 122. When composed of stamped metal, the upper end frame 128 preferably has a wall thickness ranging from about 0.040 inch to about 0.060 thick. In a preferred embodiment, the upper end frame 128 is composed of double-sided galvanized cold-rolled steel and has a wall thickness of about 0.047 inch. Referring to FIG. 6, the structural rigidity and stability of the upper end frame 128 is enhanced by its configuration, which includes a peak portion 128*a* encompassing the central bearing pocket 150 and encompassed by a downwardly sloped concave portion 128*b*. Both the bearing pocket 150 and the concave portion 128*b* extend downward from the peak portion 128*a*.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A food waste disposer, comprising:

an upper food conveying section including a first molded plastic housing forming an inlet for receiving food waste;

a lower motor section including a motor for imparting rotational movement to a motor shaft; and a central grinding section disposed between said food conveying section and said motor section, said food conveying section conveying said food waste to said grinding section, said grinding section including a grinding mechanism having a portion mounted to said motor shaft, said grinding mechanism grinding said food waste into particulate matter, said grinding section including a second molded plastic housing encompassing said grinding mechanism and integrally formed with said first plastic housing, said second molded plastic housing forming a discharge outlet.

2. The disposer of claim 1, wherein said first and second plastic housings are injection-molded.

3. The disposer of claim 2, wherein said first and second plastic housings are composed of a plastic material selected from a group consisting of acrylonitrile butadiene styrene, polyvinyl chloride, polyester, and polyphenylene sulfide.

4. The disposer of claim 1, wherein said motor section includes a motor housing enclosing said motor, said motor housing including an upper end frame separating said grinding mechanism from said motor, said upper end flame being separately formed from said first and second plastic housings.

5. The disposer of claim 4, further including a sealant bead disposed between said second plastic housing and said upper end frame, said sealant bead being composed of a tacky, malleable material.

6. The disposer of claim 5, wherein said tacky, malleable material is selected from a group consisting of butyl sealant, silicone sealant, and epoxy.

7. The disposer of claim 1, wherein said discharge outlet has a threaded outer surface adapted to threadably engage a threaded inner surface of a plumbing nut used to connect a tailpipe to said discharge outlet.

8. A food waste disposer, comprising:

an upper food conveying section including a first molded plastic housing forming an inlet for receiving food waste;

a lower motor section including a motor for imparting rotational movement to a motor shaft, said motor section including a motor housing enclosing said motor, said motor housing including an upper end frame separating said grinding mechanism from said motor, said upper end frame being separately formed from said first and second plastic housings, said upper end frame being made from stamped metal; and a central grinding section disposed between said food conveying section and said motor section, said food conveying section conveying said food waste to said grinding section, said grinding section including a grinding mechanism having a portion mounted to said motor shaft, said grinding mechanism grinding said food waste into particulate matter, said grinding section including a second molded plastic housing encompassing said grinding mechanism and integrally formed with said first plastic housing.

9. The disposer of claim 8, wherein said stamped metal is selected from a group consisting of double-sided-galvanized cold-rolled steel, cold-rolled steel, and stainless steel.

10. A food waste disposer, comprising:

an upper food conveying section including a first molded plastic housing forming an inlet for receiving food waste;

a lower motor section including a motor for imparting rotational movement to a motor shaft, said motor section including a motor housing enclosing said motor, said motor housing including an upper end frame separating said grinding mechanism from said motor, said upper end frame being separately formed from said first and second plastic housings, said upper end frame forming a central bearing pocket, said motor section further including a spherical bearing contained in said bearing pocket and encompassing said motor shaft, said spherical bearing being maintained in said bearing pocket by a bearing retainer; and a central grinding section disposed between said food conveying section and said motor section, said food conveying section conveying said food waste to said grinding section, said grinding section including a grinding mechanism having a portion mounted to said motor shaft, said grinding mechanism grinding said food waste into particulate matter, said grinding section including a second molded plastic housing encompassing said grinding mechanism and integrally formed with said first plastic housing.

11. The disposer of claim 10, wherein said upper end frame includes a peak portion encompassing said bearing pocket and encompassed by a downwardly sloped concave portion, said concave portion extending between said peak portion and said second plastic housing.

12. A food waste disposer, comprising:

an upper food conveying section including a first molded plastic housing forming and inlet for receiving food waste;

a lower motor section including a motor for imparting rotational movement to a motor shaft; and a central grinding section disposed between said food conveying section and said motor section, said food conveying section conveying said food waste to said grinding section, said grinding section including a grinding mechanism having a portion mounted to said motor shaft, said grinding mechanism grinding said food waste into particulate matter, said grinding section including a second molded plastic housing encompassing said grinding mechanism and integrally formed with said first plastic housing, said second molded plastic housing forming a discharge outlet, said motor section including a motor housing enclosing said motor, said motor housing-including an upper end frame separating said grinding mechanism from said motor, said upper end frame being separately formed from said first and second plastic housings, said motor housing including a lower end frame and a stator band extending between said upper and lower end frames, said upper end frame including a peripheral lip secured between said second plastic housing and said stator band.

13. A food waste disposer, comprising:

an upper food conveying section including a first molded plastic housing forming an inlet for receiving food waste;

a lower motor section including a motor for imparting rotational movement to a motor shaft, said motor section including a motor housing enclosing said motor; and a central grinding section disposed between said food conveying section and said motor section, said food conveying section conveying said food waste to said grinding section, said grinding section including a grinding mechanism having a portion mounted to said motor shaft, said grinding mechanism grinding said food waste into particulate matter, said grinding section including a second molded plastic housing encompassing said grinding mechanism;

said motor housing including a stamped metal upper end frame separating said grinding mechanism from said motor, said upper end frame being separately formed from said first and second molded plastic housings.

14. The disposer of claim 13, wherein said first and second molded plastic housings are injection-molded and are integrally formed with each other.

15. The disposer of claim 13, wherein said stamped metal upper end frame is composed of steel.

16. The disposer of claim 13, wherein said upper end frame forms a central bearing pocket, and wherein said motor section further includes a spherical bearing contained in said bearing pocket and encompassing said motor shaft, said spherical bearing being maintained in said bearing pocket by a bearing retainer.

17. The disposer of claim 16, wherein said upper end frame includes a peak portion encompassing said bearing pocket and encompassed by a downwardly sloped concave portion, said concave portion extending between said peak portion and said second housing.

18. The disposer of claim 13, further including a sealant bead disposed between said second housing and said upper end frame, said sealant bead being composed of a tacky, malleable material.

19. The disposer of claim 13, wherein said second housing forms a discharge outlet having a threaded outer surface adapted to threadably engage a threaded inner surface of a plumbing nut used to connect a tailpipe to said discharge outlet.

20. A food waste disposer, comprising:

grinding means, including a rotatable plate, for grinding food waste into particulate matter;

motor means for rotating said plate;

a first molded plastic housing for initially conveying said food waste to said grinding means;

a second molded plastic housing encompassing said grinding means and integrally formed with said first plastic housing; and an upper end frame separating said grinding means from said motor means and separately formed from said first and second plastic housings, said upper end frame being made from stamped metal.

21. The disposer of claim 20, wherein said second plastic housing forms a discharge outlet having a threaded outer surface adapted to threadably engage a threaded inner surface of a plumbing nut used to connect a tailpipe to said discharge outlet.

22. The disposer of claim 20, further including a stator band encompassing said motor means, said upper end frame including a peripheral lip secured between said second plastic housing and said stator band.

23. The disposer of claim 20, further including a sealant bead disposed between said second plastic housing and said upper end frame.

24. A food waste disposer, comprising grinding means, including a rotatable plate, for grinding food waste into particulate matter;

motor means for rotating said plate;

a first molded plastic housing for initially conveying said food waste to said grinding means;

a second molded plastic housing encompassing said grinding means and integrally formed with said first plastic housing; and an upper end frame separating said grinding means from said motor means and separately formed from said first and second plastic housings, said first and second plastic housings being injection-molded and said upper end frame being composed of stamped metal.

25. A food waste disposer, comprising:

grinding means, including a rotatable plate, for grinding food waste into particulate matter;

motor means for rotating said plate;

a first molded plastic housing for initially conveying said food waste to said grinding means;

a second molded plastic housing encompassing said grinding means and integrally formed with said first plastic housing; and an upper end frame separating said grinding means from said motor means and separately formed from said first and second plastic housings, said upper end frame including a central bearing pocket, a peak portion, and a downwardly sloped concave portion, said peak portion encompassing said bearing pocket and being encompassed by said downwardly sloped concave portion, said concave portion extending between said peak portion and said second plastic housing.

26. The disposer of claim 25, further including a spherical bearing contained in said bearing pocket and maintained therein by a bearing retainer.

27. The disposer of claim 25, wherein said bearing pocket and said concave portion extend downward from said peak portion.

28. A method of manufacturing a food waste disposer, said method comprising:

providing a grinding mechanism for grinding food waste into particulate matter, said grinding mechanism including a rotatable plate;

providing a motor for imparting rotational movement to a motor shaft;

mounting said plate to said motor shaft;

forming a unitary molded plastic enclosure including a first molded plastic housing and a second molded plastic housing, said first and second plastic housings being integrally formed with each other;

forming a discharge outlet in said second molded plastic housing;

positioning said unitary plastic enclosure such that said second plastic housing encompasses said grinding mechanism and said first plastic housing is adapted to initially convey said food waste to said grinding mechanism;

forming an upper end frame; and positioning an upper end frame between said grinding mechanism and said motor, said upper end frame being separately formed from said unitary plastic enclosure.

29. The method of claim 28, wherein said forming said discharge outlet includes forming said discharge outlet having a threaded outer surface adapted to threadably engage a threaded inner surface of a plumbing nut used to connect a tailpipe to said discharge outlet.

30. A method of manufacturing a food waste disposer, said method comprising:

providing a grinding mechanism for grinding food waste into particulate matter, said grinding mechanism including a rotatable plate;

providing a motor for imparting rotational movement to a motor shaft;

mounting said plate to said motor shaft;

forming a unitary molded plastic enclosure including a first molded plastic housing and a second molded plastic housing, said first and second plastic housings being integrally formed with each other;

forming a discharge outlet in said second molded plastic housing;

positioning said unitary plastic enclosure such that said second plastic housing encompasses said grinding mechanism and said first plastic housing is adapted to initially convey said food waste to said grinding mechanism;

forming an upper end frame;

providing a stator band and positioning said stator band about said motor; and positioning an upper end frame between said grinding mechanism and said motor, and securing a peripheral lip of said upper end frame between said second plastic housing and said stator band, said upper end frame being separately formed from said unitary plastic enclosure.

31. A method of manufacturing a food waste disposer, said method comprising:

providing a grinding mechanism for grinding food waste into particulate matter, said grinding mechanism including a rotatable plate;

providing a motor for imparting rotational movement to a motor shaft;

mounting said plate to said motor shaft;

forming a unitary molded plastic enclosure including a first molded plastic housing and a second molded plastic housing by injection molding, said first and second plastic housings being integrally formed with each other;

positioning said unitary plastic enclosure such that said second plastic housing encompasses said grinding mechanism and said first plastic housing is adapted to initially convey said food waste to said grinding mechanism;

forming an upper end frame by cold stamping said upper end frame from a sheet of metal; and positioning an upper end frame between said grinding mechanism and said motor, said upper end frame being separately formed from said unitary plastic enclosure.

32. A method of manufacturing a food waste disposer, said method comprising:

providing a grinding mechanism for grinding food waste into particulate matters, said grinding mechanism including a rotatable plate;

providing a motor for imparting rotational movement to a motor shaft;

mounting said plate to said motor shaft;

forming a unitary molded plastic enclosure including a first molded plastic housing and a second molded plastic housing, said first and second plastic housings being integrally formed with each other;

positioning said unitary plastic enclosure such that said second plastic housing encompasses said grinding mechanism and said first plastic housing is adapted to initially convey said food waste to said grinding mechanism;

forming an upper end frame having a central bearing pocket, a peak portion, and a downwardly sloped concave portion, said peak portion encompassing said bearing pocket and being encompassed by said downwardly sloped concave portion, said concave portion extending between said peak portion and said second plastic housing; and positioning an upper end frame between said grinding mechanism and said motor, said upper end frame being separately formed from said unitary plastic enclosure.

33. The method of claim 32, wherein said step of mounting said plate to said motor shaft includes positioning a spherical bearing in said bearing pocket and covering said spherical bearing with a bearing retainer.

34. The method of claim 32, wherein said forming said upper end frame includes forming said bearing pocket and said concave portion such that said bearing pocket and said concave portion extend downward from said peak portion.

35. A food waste disposer, comprising:

an upper food conveying section including a first molded plastic housing forming an inlet for receiving food waste;

a lower motor section including a motor for imparting rotational movement to a motor shaft; and a central grinding section disposed between said food conveying section and said motor section, said food conveying section conveying said food waste to said grinding section, said grinding section including a grinding mechanism having a portion mounted to said motor shaft, said grinding mechanism grinding said food waste into particulate matter, said grinding section including a second molded plastic housing encompassing said grinding mechanism and integrally formed with said first plastic housing, said second plastic housing forming a discharge outlet having a threaded surface.

36. The disposer of claim 35, wherein said threaded surface is adapted to threadably engage a threaded surface of a plumbing nut used to connect a tailpipe to said discharge outlet.

37. The disposer of claim 35, wherein said plastic housing is injection-molded.

38. The disposer of claim 35, wherein said plastic housing is composed of a plastic material selected from a group consisting of acrylonitrile butadiene styrene, polyvinyl chloride, polyester, and polyphenylene sulfide.

* * * * *

UNITED STATES PATENT AND TRADEMARK OFFICE

CERTIFICATE OF CORRECTION

PATENT NO.: 6,007,006

DATED: December 28, 1999

INVENTOR(S): Engel et al.

It is certified that errors appear in the above-identified patent, and that said Letters Patent is hereby corrected as shown below.

Column 6, Claim 4, line 1, delete "flame" and insert --frame--

Column 7, Claim 12, line 6, delete "and" and insert --an--

Column 7, Claim 12, line 22, delete "housing-including" and insert --housing including--

Column 10, Claim 32, line 27, delete "matters" and insert --matter--

Signed and Sealed this

Twelfth Day of December, 2000

*Attest:*

Q. TODD DICKINSON

*Attesting Officer*

*Director of Patents and Trademarks*